US010717639B2

(12) United States Patent
Walther

(10) Patent No.: US 10,717,639 B2
(45) Date of Patent: Jul. 21, 2020

(54) MOBILE AUXILIARY DISTRIBUTION STATION

(71) Applicant: Fuel Automation Station, LLC, Birmingham, MI (US)

(72) Inventor: Garrett Walther, Frederick, CO (US)

(73) Assignee: FUEL AUTOMATION STATION, LLC., Birmingham, MI (US)

( * ) Notice: Subject to any disclaimer, the term of this patent is extended or adjusted under 35 U.S.C. 154(b) by 22 days.

(21) Appl. No.: 16/015,764

(22) Filed: Jun. 22, 2018

(65) Prior Publication Data

US 2019/0359476 A1 Nov. 28, 2019

Related U.S. Application Data

(60) Provisional application No. 62/676,002, filed on May 24, 2018.

(51) Int. Cl.

| | |
|---|---|
| ***B67D 7/08*** | (2010.01) |
| ***B67D 7/40*** | (2010.01) |
| ***B67D 7/84*** | (2010.01) |
| ***B67D 7/78*** | (2010.01) |
| ***B67D 7/62*** | (2010.01) |
| ***B65H 75/44*** | (2006.01) |

(52) U.S. Cl.

CPC ..... *B67D 7/08* (2013.01); *B65H 75/4402* (2013.01); *B67D 7/40* (2013.01); *B67D 7/62* (2013.01); *B67D 7/78* (2013.01); *B67D 7/845* (2013.01); *Y10T 137/6899* (2015.04)

(58) Field of Classification Search

CPC . B67D 7/845; B67D 7/08; B67D 7/40; B67D 7/62; B67D 7/78; A62C 25/00; A62C 27/00; Y10T 137/6899; B65H 75/42; B65H 75/425

USPC ..... 137/343, 899, 355.12

See application file for complete search history.

(56) References Cited

U.S. PATENT DOCUMENTS

| | | | | |
|---|---|---|---|---|
| 881,873 A * | 3/1908 | Sanford | A62C 27/00 169/24 |
| 1,703,669 A * | 2/1929 | Hansen-Ellehammer | A62C 27/00 180/53.61 |
| 3,028,010 A * | 4/1962 | Headrick | B64F 1/28 210/172.1 |
| 3,628,728 A * | 12/1971 | Polutnik | B05B 3/18 239/159 |
| 3,720,226 A * | 3/1973 | Minich, Jr. et al. | B60P 3/14 137/334 |
| 3,810,487 A * | 5/1974 | Cable | B60P 3/14 137/351 |

(Continued)

*Primary Examiner* — Kevin F Murphy
*Assistant Examiner* — Jonathan J Waddy
(74) *Attorney, Agent, or Firm* — Carlson, Gaskey & Olds, P.C.

(57) ABSTRACT

An auxiliary distribution station is configured to be used in cooperation with a primary distribution station. The auxiliary distribution system includes a mobile vehicle, an auxiliary hose reel and auxiliary hose, a lift, a tank, a pump, an auxiliary meter, and a tank hose. The auxiliary hose is configured to be fluidly connected with a hose of the primary distribution station. The lift is configured to move and deploy the auxiliary hose reel from the mobile vehicle. The pump is operable to pump fluid from the tank, through the meter, and through the tank hose.

19 Claims, 3 Drawing Sheets

(56) References Cited

U.S. PATENT DOCUMENTS

| | | | | | |
|---|---|---|---|---|---|
| 4,306,682 | A * | 12/1981 | Toussaint | A01G 25/095 | 137/355.27 |
| 4,830,283 | A * | 5/1989 | Johnson | A01G 25/095 | 137/355.2 |
| 6,945,288 | B1 * | 9/2005 | Brakefield | B67D 7/04 | 141/231 |
| 7,566,024 | B2 * | 7/2009 | Krise | B60P 1/6463 | 242/397.1 |
| 7,856,998 | B2 * | 12/2010 | Bauer | B60P 3/14 | 137/15.16 |
| 8,499,782 | B2 * | 8/2013 | Bauer | B60P 3/14 | 137/267 |
| 2004/0007286 | A1 * | 1/2004 | Kamikozuru | B60P 3/2245 | 141/231 |
| 2009/0314384 | A1 * | 12/2009 | Brakefield | B67D 7/04 | 141/67 |
| 2010/0200107 | A1 * | 8/2010 | Weathers | B67D 7/02 | 141/4 |
| 2011/0197988 | A1 * | 8/2011 | Van Vliet | B67D 7/04 | 141/1 |
| 2013/0087227 | A1 * | 4/2013 | Metz | B67D 7/02 | 137/565.01 |
| 2013/0239345 | A1 * | 9/2013 | Giustetto | A47L 1/08 | 15/104.94 |
| 2014/0352830 | A1 * | 12/2014 | Kenan | B67D 7/763 | 137/899 |
| 2016/0348897 | A1 * | 12/2016 | Suntup | F04B 13/00 | |
| 2017/0313570 | A1 * | 11/2017 | Kittoe | B67D 7/3209 | |
| 2018/0099837 | A1 * | 4/2018 | Bambauer | B65H 75/4489 | |
| 2018/0285847 | A1 * | 10/2018 | Pier | G06Q 20/18 | |
| 2019/0031497 | A1 * | 1/2019 | Frizzie | B67D 7/845 | |

* cited by examiner

MOBILE AUXILIARY DISTRIBUTION STATION

CROSS-REFERENCE TO RELATED APPLICATION

This application claims priority to U.S. Provisional Application No. 62/676,002 filed May 24, 2018.

BACKGROUND

Hydraulic fracturing (also known as fracking) is a well-stimulation process that utilizes pressurized liquids to fracture rock formations. Pumps and other equipment used for hydraulic fracturing typically operate at the surface of the well site. The equipment may operate until refueling is needed, at which time the equipment may be shut-down for refueling. Shut-downs are costly and reduce efficiency. More preferably, to avoid shut-downs fuel is replenished in a hot-refueling operation while the equipment continues to run. This permits fracking operations to proceed continuously. However, hot-refueling can be difficult to reliably sustain for the duration of the fracking operation.

A primary fuel distribution station can be used to fuel such equipment continuously. An example fuel distribution system can include a mobile trailer, a pump on the mobile trailer, a meter or register connected to the pump to track the amount of fuel pumped, a manifold on the mobile trailer and connected with the pump, a plurality of hoses connected with the manifold, a plurality of valves on the mobile trailer situated between the manifold and a respective different one of the hoses, a plurality of fluid level sensors associated with a respective different one of the valves, and a controller configured to communicate with the fluid level sensors and operate the valves responsive to signals from the fluid level sensors. The hoses can be connected to the fuel tanks of the equipment, such as by a cap, which may be integrated with the fluid level sensor. When one of the pieces of equipment reaches a level that is designated as low, the controller opens the valve that corresponds to the hose that is attached to the fuel tank of that piece of equipment, thereby permitting fuel to flow from the manifold to fill the fuel tank. When the fuel reaches a level designated as full in the fuel tank, the controller closes the valve.

SUMMARY

A distribution system according to an example of the present disclosure includes a primary distribution station that has a mobile trailer, a pump on the mobile trailer, a manifold on the mobile trailer and fluidly connected with the pump, a plurality of reels on the mobile trailer, a plurality of hoses, each hose connected with a different one of the reels and connected to be fed from the manifold, a plurality of valves on the mobile trailer, each valve situated between the manifold and a respective different one of the reels, a plurality of fluid level sensors, each fluid level sensor being associated with a different one of the hoses, and a controller configured to individually open and close the valves responsive to the fluid level sensors. An auxiliary distribution station has a mobile vehicle, and an auxiliary hose reel and auxiliary hose on the mobile vehicle. The auxiliary hose is configured to be fluidly connected with at least one of the plurality of hoses of the primary distribution station, and a lift on the mobile vehicle. The lift is configured to move and deploy the auxiliary hose reel from the mobile vehicle. A first tank on the mobile vehicle, and a pump, an auxiliary meter, and a tank hose is operable to pump fluid from the first tank, through the meter, and through the tank hose.

In a further embodiment of any of the foregoing embodiments, the mobile vehicle is a truck.

In a further embodiment of any of the foregoing embodiments, the lift is a winch.

A further embodiment of any of the foregoing embodiments includes at least a second tank and a third tank on the mobile vehicle. The third tank is different in volumetric size than the first tank and the second tank.

In a further embodiment of any of the foregoing embodiments, the third tank is larger in volumetric size than the first tank and the second tank.

In a further embodiment of any of the foregoing embodiments, the third tank is between the first tank and the second tank.

A further embodiment of any of the foregoing embodiments includes fuel in the first tank and diesel exhaust fluid in the third tank.

In a further embodiment of any of the foregoing embodiments, the auxiliary hose includes a manual pump handle.

In a further embodiment of any of the foregoing embodiments, the mobile vehicle has a cab and a truck bed, and the auxiliary hose reel is located in a rear 50% of the length of the truck bed.

In a further embodiment of any of the foregoing embodiments, the lift is located in the rear 50% of the length of the truck bed.

In a further embodiment of any of the foregoing embodiments, the lift is aft of the auxiliary hose reel on the truck bed.

In a further embodiment of any of the foregoing embodiments, the lift is a winch.

A distribution system according to an example of the present disclosure includes an auxiliary distribution station configured to be used in cooperation with a primary distribution station. The auxiliary distribution system has a mobile vehicle, and an auxiliary hose reel and auxiliary hose on the mobile vehicle. The auxiliary hose is configured to be fluidly connected with a hose of the primary distribution station. A lift on the mobile vehicle, is configured to move and deploy the auxiliary hose reel from the mobile vehicle. A tank on the mobile vehicle, and a pump, an auxiliary meter, and a tank hose is operable to pump fluid from the tank, through the meter, and through the tank hose.

In a further embodiment of any of the foregoing embodiments, the mobile vehicle is a truck and the lift is a winch.

A further embodiment of any of the foregoing embodiments includes at least a second tank and a third tank on the mobile vehicle. The third tank is different in volumetric size than the first tank and the second tank.

In a further embodiment of any of the foregoing embodiments, the third tank is larger in volumetric size than the first tank and the second tank.

A further embodiment of any of the foregoing embodiments includes fuel in the first tank and diesel exhaust fluid in the third tank.

In a further embodiment of any of the foregoing embodiments, the auxiliary hose includes a manual pump handle.

In a further embodiment of any of the foregoing embodiments, the mobile vehicle has a cab and a truck bed, and the auxiliary hose reel is located in a rear 50% of the length of the truck bed, and the lift is aft of the auxiliary hose reel on the truck bed.

A method for use in a distribution system according to an example of the present disclosure includes distributing a fluid using a primary distribution station as described in any of the examples above, using a primary meter on the primary distribution station to track the amount of fluid distributed by the primary distribution system, connecting one of the hoses of the primary distribution station to an auxiliary hose on an auxiliary distribution station as described in the examples above, distributing the fluid from the primary distribution station through the hose that is connected with the auxiliary hose to distribute fluid through the auxiliary hose, and using the primary meter on the primary distribution station to track the amount of fluid distributed through the auxiliary hose.

BRIEF DESCRIPTION OF THE DRAWINGS

The various features and advantages of the present disclosure will become apparent to those skilled in the art from the following detailed description. The drawings that accompany the detailed description can be briefly described as follows.

WRITTEN DESCRIPTION

Figure 1:
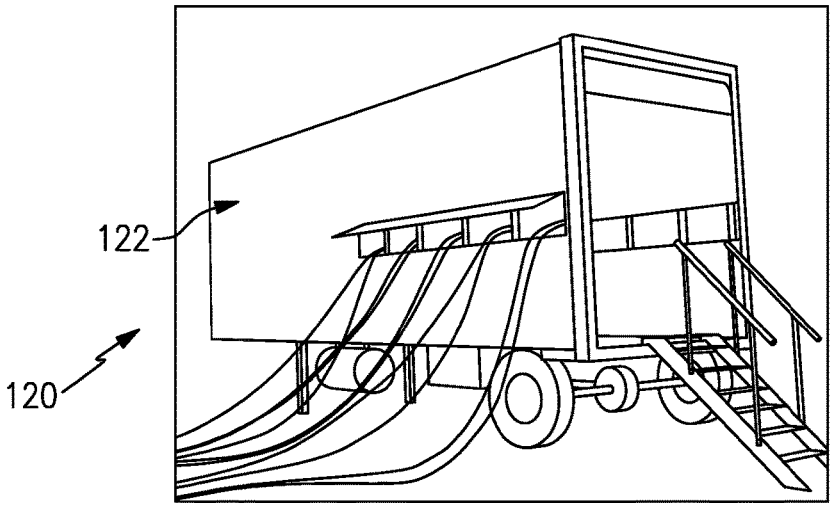
FIG. 1 illustrates an example primary mobile distribution station.
Figure 2:
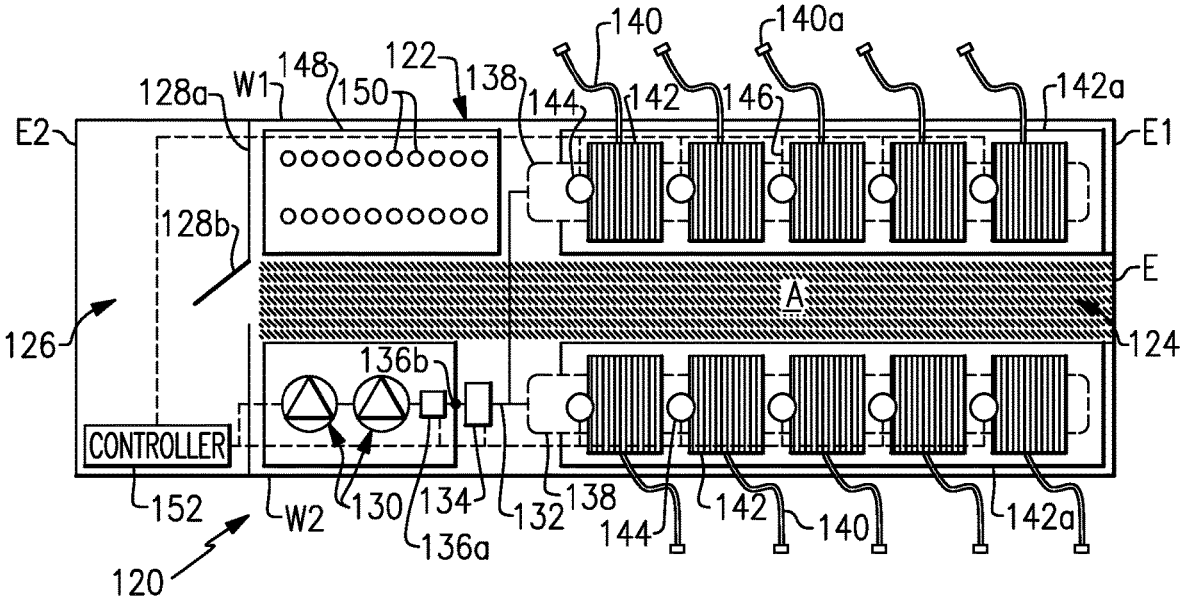
FIG. 2 illustrates an internal layout of a mobile auxiliary distribution station.

FIG. 1 illustrates a mobile distribution station 120 and FIG. 2 illustrates an internal layout of the station 120, which for purposes herein is a primary distribution station. Such a station 20 is also disclosed in co-owned application Ser. No. 15/290,331, incorporated herein by reference. The station 120 may serve in a "hot-refueling" capacity to distribute fuel to multiple pieces of equipment while the equipment is running, such as fracking equipment at a well site. As will be appreciated, the station 120 is not limited to applications for fracking or for delivering fuel. The examples herein may be presented with respect to fuel delivery, but the station 120 may be used in mobile delivery of other fluids, in other gas/petroleum recovery operations, or in other operations where mobile refueling or fluid delivery will be of benefit.

In this example, the station 120 includes a mobile trailer 122. Generally, the mobile trailer 122 is elongated and has first and second opposed trailer side walls W1 and W2 that join first and second opposed trailer end walls E1 and E2. Most typically, the trailer 122 will also have a closed top (not shown). The mobile trailer 122 may have wheels that permit the mobile trailer 122 to be moved by a vehicle from site to site to service different hot-refueling operations. In this example, the mobile trailer 122 has two compartments. A first compartment 124 includes the physical components for distributing fuel, such as diesel fuel, and a second compartment 126 serves as an isolated control room for managing and monitoring fuel distribution. The compartments 124/126 are separated by an inside wall 128*a* that has an inside door 128*b*.

The first compartment 124 includes one or more pumps 130. Fuel may be provided to the one or more pumps 130 from an external fuel source, such as a tanker truck on the site. On the trailer 122, the one or more pumps 130 are fluidly connected via a fuel line 132 with a high precision register/meter 134 for metering fuel. The fuel line 132 may include, but is not limited to, hard piping. In this example, the fuel line 132 includes a filtration and air eliminator system 136*a* and one or more sensors 136*b*. Although optional, the system 136*a* is beneficial in many implementations, to remove foreign particles and air from the fuel prior to delivery to the equipment. The one or more sensors 136*b* may include a temperature sensor, a pressure sensor, or a combination thereof, which assist in fuel distribution management.

The fuel line 132 is connected with one or more manifolds 138. In the illustrated example, the station 120 includes two manifolds 138 that arranged on opposed sides of the compartment 124. As an example, the manifolds 138 are elongated tubes that are generally larger in diameter than the fuel line 132 and that have at least one inlet and multiple outlets. Each hose 140 is wound, at least initially, on a reel 142 that is rotatable to extend or retract the hose 140 externally through one or more windows of the trailer 122. Each reel 142 may have an associated motor to mechanically extend and retract the hose 140.

The reels 142 are mounted on a support rack 142*a*. The support rack 142*a* may be configured with upper and lower rows of reels 142. In this example there are two support racks 142*a* arranged on opposed sides of the first compartment 124, with an aisle (A) that runs between the support racks 142*a* from an outside door E to the inside door 128*b*. As will be appreciated, fewer or additional reels and hoses than shown may be used in alternative examples.

Each hose 140 is connected to a respective one of the reels 142 and a respective one of a plurality of control valves 144. For example, a secondary fuel line 146 leads from the manifold 138 to the reel 142. The control valve 144 is in the secondary fuel line 146. The control valve 144 is moveable between open and closed positions to selectively permit fuel flow from the manifold 138 to the reel 142 and the hose 140. For example, the control valve 144 is a powered valve, such as a solenoid valve.

In the illustrated example, the first compartment 124 also includes a sensor support rack 148. The sensor support rack 148 holds integrated fuel cap sensors 150 (when not in use), or at least portions thereof. When in use, each integrated fuel cap sensor 150 is temporarily affixed to a piece of equipment (i.e., the fuel tank of the equipment) that is subject to the hot-refueling operation. Each hose 140 may include a connector end 140*a* and each integrated fuel cap sensor 150 may have a corresponding mating connector to facilitate rapid connection and disconnection of the hose 140 with the integrated fuel cap sensor 150. For example, the connector end 140*a* and mating connector on the integrated fuel cap sensor 150 form a hydraulic quick-connect.

At least the control valves 144, pump or pumps 130, sensor or sensors 136*b*, and register 134 are in communication with a controller 152 located in the second compartment 126. As an example, the controller 152 includes software, hardware, or both that is configured to carry out any of the functions described herein. In one further example, the controller 152 includes a programmable logic controller with a touch-screen for user input and display of status data. For example, the screen may simultaneously show multiple fluid levels of the equipment that is being serviced.

When in operation, the integrated fuel cap sensors 150 are mounted on respective fuel tanks of the pieces of equipment that are subject to the hot-refueling operation. The hoses 140 are connected to the respective integrated fuel cap sensors 150. Each integrated fuel cap sensor 150 generates signals that are indicative of the fuel level in the fuel tank of the piece of equipment on which the integrated fuel cap sensor 150 is mounted. The signals are communicated to the controller 152.

The controller 152 interprets the signals and determines the fuel level for each fuel tank of each piece of equipment. In response to a fuel level that falls below a lower threshold, the controller 152 opens the control valve 144 associated with the hose 140 to that fuel tank and activates the pump or pumps 130. The pump or pumps 130 provide fuel flow into the manifolds 138 and through the open control valve 144 and reel 142 such that fuel is provided through the respective hose 140 and integrated fuel cap sensor 150 into the fuel tank. The lower threshold may correspond to an empty fuel level of the fuel tank, but more typically the lower threshold will be a level above the empty level to reduce the potential that the equipment completely runs out of fuel and shuts down.

The controller 152 also determines when the fuel level in the fuel tank reaches an upper threshold. The upper threshold may correspond to a full fuel level of the fuel tank, but more typically the upper threshold will be a level below the full level to reduce the potential for overflow. In response to reaching the upper threshold, the controller 152 closes the respective control valve 144 and ceases the pump or pumps 130. If other control valves 144 are open or are to be opened, the pump or pumps 130 may remain on.

Multiple control valves 144 may be open at one time, to provide fuel to multiple fuel tanks at one time. Alternatively, if there is demand for fuel from two or more fuel tanks, the controller 152 may sequentially open the control valves 44 such that the tanks are refueled sequentially. For instance, upon completion of refueling of one fuel tank, the controller 152 closes the control valve 144 of the hose 140 associated with that tank and then opens the next control valve 144 to begin refueling the next fuel tank. Sequential refueling may facilitate maintaining internal pressure in the manifold 138 and fuel line 132 above a desired or preset pressure threshold to more rapidly deliver fuel. Similarly, the controller 152 may limit the number of control valves 144 that are open at any one instance in order to maintain the internal pressure in the manifold 138 and fuel line 132 above a desired or preset threshold. The controller 152 may perform the functions above while in an automated operating mode. Additionally, the controller 152 may have a manual mode in which a user can control at least some functions through the PLC, such as starting and stopped the pump 130 and opening and closing control valves 144. For example, manual mode may be used at the beginning of a job when initially filling tanks to levels at which the fuel cap sensors 150 can detect fuel and/or during a job if a fuel cap sensor 150 becomes inoperable. Of course, operating in manual mode may deactivate some automated functions, such as filling at the low threshold or stopping at the high threshold.

In addition to the use of the sensor signals to determine fuel level, or even as an alternative to use of the sensor signals, the refueling may be time-based. For instance, the fuel consumption of a given piece of equipment may be known such that the fuel tank reaches the lower threshold at known time intervals. The controller 152 is operable to refuel the fuel tank at the time intervals rather than on the basis of the sensor signals, although sensor signals may also be used to verify fuel level.

The controller 152 also tracks the amount of fuel provided to the fuel tanks. For instance, the register 134 precisely measures the amount of fuel provided from the pump or pumps 130. As an example, the register 134 is an electronic register and has a resolution of about 0.1 gallons. The register 134 communicates measurement data to the controller 152. The controller 152 can thus determine the total amount of fuel used to very precise levels. The controller 152 may also be configured to provide outputs of the total amount of fuel consumed. For instance, a user may program the controller 152 to provide outputs at desired intervals, such as by worker shifts or daily, weekly, or monthly periods. The outputs may also be used to generate invoices for the amount of fuel used. As an example, the controller 152 may provide a daily output of fuel use and trigger the generation of an invoice that corresponds to the daily fuel use, thereby enabling almost instantaneous invoicing.

A mobile auxiliary fuel distribution station may be used with the primary fuel distribution station 120. The figures herewith depict various views of an example auxiliary mobile fuel distribution station 20 ("station 20"). Again, although the examples may be described with respect to refueling, neither the auxiliary nor primary distribution stations are limited to refueling or fracking and may alternatively be used at other types of well sites, or at non-well sites, and for other types of fluids, such as water.

Figure 3A:
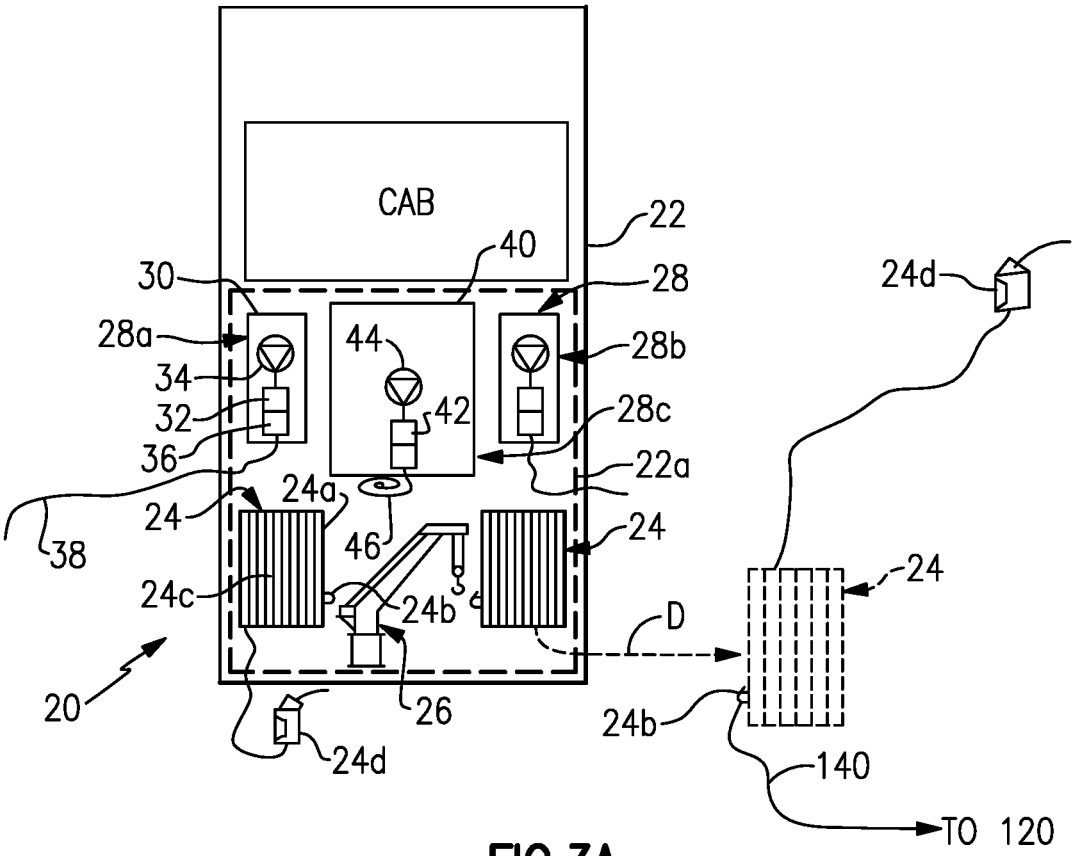
FIG. 3A illustrates an overhead layout view of a mobile auxiliary distribution station.
Figure 3B:
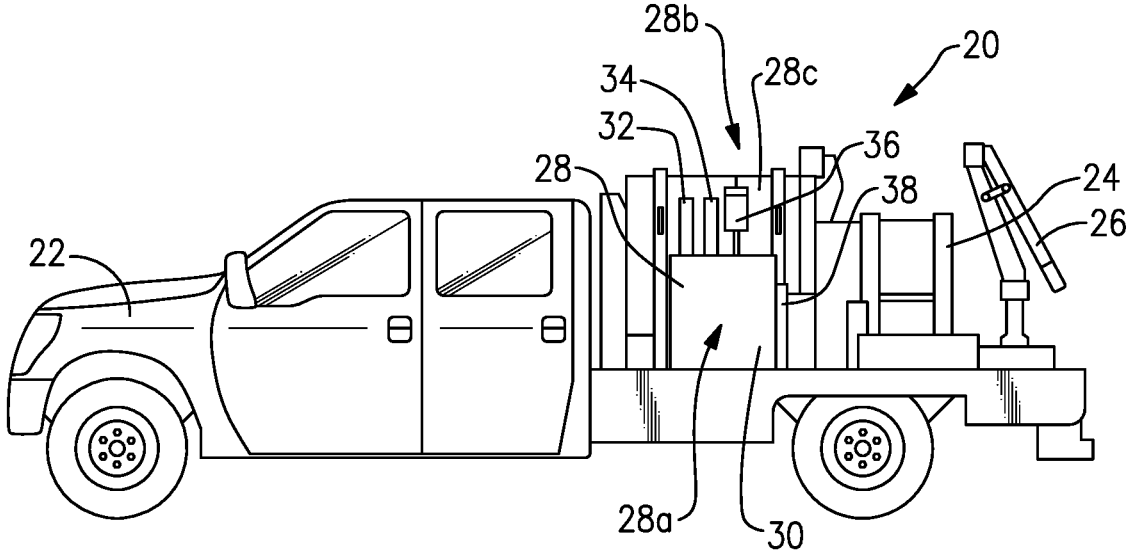
FIG. 3B illustrates a side view of the mobile auxiliary distribution station.
Figure 3C:
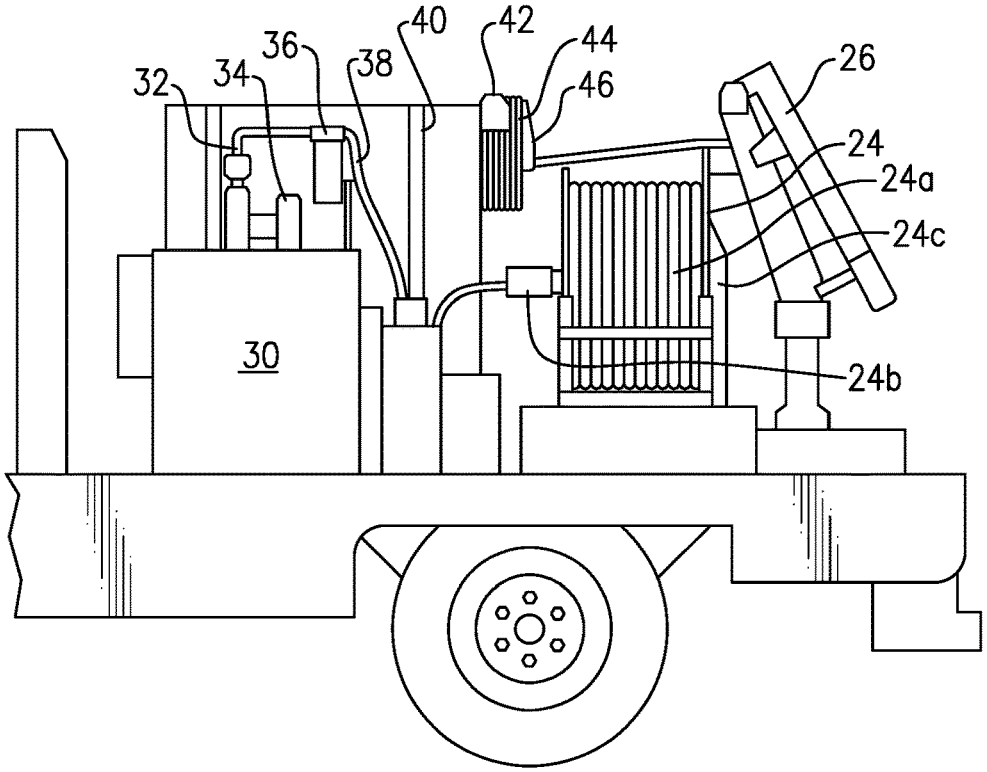
FIG. 3C illustrates another side view of the mobile auxiliary distribution station.

FIG. 3A shows an overhead schematic view of the station 20. As shown also in FIGS. 3A/3B, the station 20 includes a flat-bed truck 22 that carries components that will be described in more detail below. In the examples below, the flat-bed truck 22 may alternatively be replaced by another type of mobile vehicle or mobile platform. Examples may include, but are not limited to, other types of trucks or mobile vehicles that are powered and can be driven from place to place without the aid of another vehicle, or trailers or the like that may not be powered by can be towed or moved by another vehicle.

Figure 4:
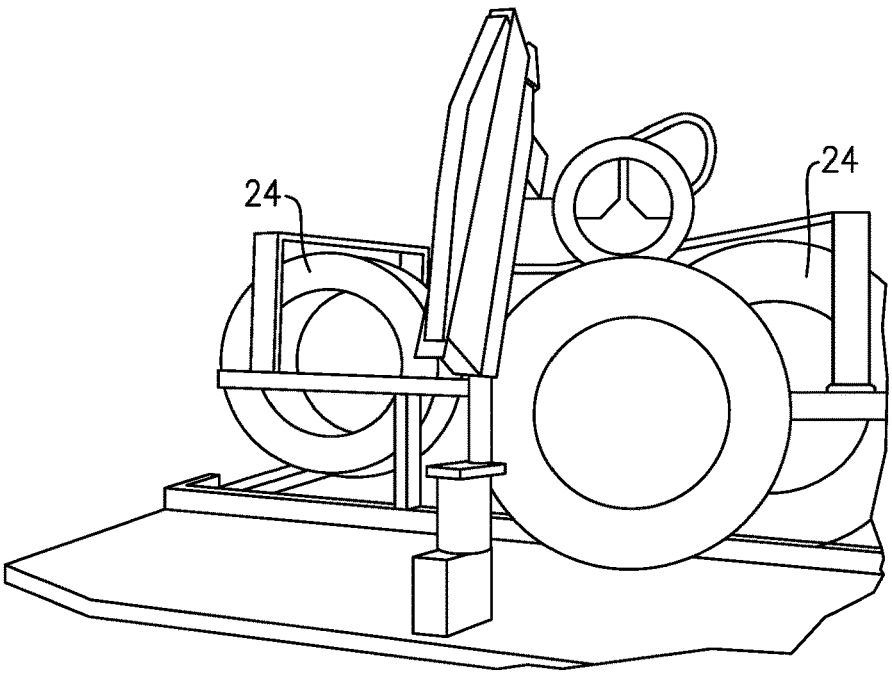
FIG. 4 illustrates a rear view of the mobile auxiliary distribution station.

The truck 22 carries on its bed 22*a* one or more hose reels 24. In the depicted example, also shown in a rear view in FIG. 4, there are two hose reels 24, but there may alternatively be one reel 24 or more than two reels 24 as long as there is space on the bed. The reel or reels 24 are arranged toward the rear of the bed, near a lift 26. For purposes herein, the "rear" is the end opposite the cab of the truck. The reel or reels 24 may be secured to the bed 22*a*, such as with one or more fasteners. The fasteners are readily removable such that the reel or reels 24 can be secured to the truck 22 when not in use, and then deployed from the truck 22 for use by removal of the fasteners.

As an example, the reel or reels 24 are on the rear 50% of the length of the bed. Each reel 24 includes a spool 24*a* and a connector 24*b*. For instance, the connector 24*b* is a quick connect, dry connect, or other type of connector that is configured to fluidly connect to one of the hoses 140 from the primary distribution station 120. In this regard, the connector 24*b* and the connector end 140*a* of the hose 140 from the primary distribution station 120 are complimentary in that they are compatible to make a secure, sealed connection. There is a passage from the connector 24*b* and through the spool 24*a*. The spool 24*a* includes another connector for the hose 24*c* on the reel 24 to connect to. Thus, the hose 24*c* can be fluidly connected to the hose 140 from the primary distribution station 120 via the connector 24*b*. The free end of the hose 24*c* may be outfitted with a connector or manual pump handle 24*d*. Example connectors may include quick connects or dry connects, and example pump handles may include a manual pump nozzle with automatic shut-off.

In this example, the lift 26 is a winch, which may have a rope, cable, chain, or the like wound around a rotating drum, turned by a crank, motor, or other power source. The lift 26 is operable to lift and move one of the reels 24 from the bed of the truck 22 onto the ground adjacent the truck 22. In this regard, other types of lifts than a winch could alternatively be used.

The truck 22 additionally includes one or more tanks 28, which here are located between the cab of the truck 22 and the reel or reels 24. For instance, the tanks 28 are generally located on the forward 50% of the length of the bed. In this example, there are three tanks, designated at 28*a*/28*b*/28*c*. The tank 28*c* is located between tanks 28*a* and 28*b*, and tank 28*b* may thus be obscured from view on some of the figures. Additionally, in this example, the tank 28*c* is larger than either of tanks 28*a* or 28*b*. For example, the tank 28*c* may be at least 4X larger (in gallons) than either of the tanks 28*a* or 28*b*.

Each tank 28*a* and 28*b* includes a tank portion 30 (e.g., a reservoir), a meter or register 32, a pump 34, a filter 36, and a hose 38 (auxiliary hose). The pump 34 is operable to move fluid from the tank portion 30, then through the meter 32 to the filter 36 and into the hose 38. The meter 32 measures the amount of fluid provided from the tank portion 30. Thus, the amount of fluid used can be tracked. As an example, the tanks 28*a* and 28*b* may hold fuel, for fueling equipment, vehicles, generators, or other devices at a site where the primary distribution station is used. In some examples, the fuels may be different, such as clear and dyed diesel fuels.

The tank 28*c* is of larger capacity. The tank 28*c* may likewise include a tank portion 40, a meter 42, a pump 44, and a hose 46. As an example, the tank 28*c* may hold a third fluid that is different than the fluids in either of the tanks 28*a*/28*b*. In one example, the fluid is diesel exhaust fluid (DEF), which is typically an aqueous urea solution. Due to the corrosivity of the DEF, the tank 28*c* may be formed of a corrosion resistant material, such as a polymer or stainless steel. The free ends of the hose 24*c*/46 may be outfitted with a connector or pump handle. Example connectors may include quick connects or dry connects, and example pump handles may include a manual pump nozzle with automatic shut-off.

The station 20 is a multi-function refueling solution that may be used alone or in cooperation with the primary distribution station 120. For example, the reel or reels 24 enable cooperative use with the primary distribution station 120. In this regard, a hose 140 from the primary distribution station 120 may be connected to the reel 24 such that fuel from the primary distribution station is provided through the hose 24*c* of the reel 24. For instance, the reel 24 may be deployed (e.g., removed), as represented at D, from the truck 22, using the lift 26, at a desired location such that the hose 24*c* from the reel 24 can reach a device that is in need of refueling. This enables the amount of fuel used to be tracked using the register/meter 134 of the primary distribution station 120. This also enables devices that may be out of range of the primary distribution station 120 to be refueled using the station 20. Furthermore, the deployability of the reel 24 also enables the truck 22 to be used elsewhere while the reel 24 is in use. That is, the truck 22, with its tanks 28*a*/28*b*/28*c*, can service refueling needs elsewhere while the reel 24 is in use. Similarly, for two reels 24, the two reels 24 can be deployed and the truck 22 can service other refueling needs elsewhere. The station 20 thus provides a great deal of mobility and refueling flexibility in order to meet refueling needs at specific locations that may be out of range of the primary distribution station 120 or difficult to reach. Additionally, the station 20 is highly mobile and may replace use of much larger and less mobile tank wagons. Alternatively, if the reel or reels 24 are not in use, the truck 22 can be used alone to service a variety of refueling needs using different fuels in the tanks 28*a*/28*b*/28*c*.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A distribution system comprising:

an auxiliary distribution station configured to be used in cooperation with a primary distribution station, the auxiliary distribution system including, a mobile vehicle, an auxiliary hose reel and auxiliary hose on the mobile vehicle, the auxiliary hose reel having first and second connectors, the first connector being secured with the auxiliary hose and the second connector being configured to be secured with a complementary connector end of a hose of the primary distribution station, a lift on the mobile vehicle, the lift configured to move and deploy the auxiliary hose reel from the mobile vehicle at a location when the second connector is secured with the complementary connector end such that the mobile vehicle can leave the location without the auxiliary hose reel and auxiliary hose, a first tank on the mobile vehicle, and a pump, an auxiliary meter, and a tank hose, the pump operable to pump fluid from the tank, through the meter, and through the tank hose.

2. The distribution system as recited in claim 1, wherein the mobile vehicle is a truck and the lift is a winch.

3. The distribution system as recited in claim 2, further comprising at least a second tank and a third tank on the mobile vehicle, the third tank being different in volumetric size than the first tank and the second tank.

4. The distribution system as recited in claim 3, wherein the third tank is larger in volumetric size than the first tank and the second tank.

5. The distribution system as recited in claim 4, further comprising fuel in the first tank and diesel exhaust fluid in the third tank.

6. The distribution system as recited in claim 5, wherein the auxiliary hose includes a manual pump handle.

7. The distribution system as recited in claim 6, wherein the mobile vehicle has a cab and a truck bed, and the auxiliary hose reel is located in a rear 50% of the length of the truck bed, and the lift is aft of the auxiliary hose reel on the truck bed.

8. A distribution system comprising:

a primary distribution station including-, a mobile trailer, a pump on the mobile trailer, a manifold on the mobile trailer and fluidly connected with the pump;

a plurality of reels on the mobile trailer, a plurality of hoses, each said hose connected with a different one of the reels and connected to be fed from the manifold, a plurality of valves on the mobile trailer, each said valve situated between the manifold and a respective different one of the reels, a plurality of fluid level sensors, each said fluid level sensor being associated with a different one of the hoses, and a controller configured to individually open and close the valves responsive to the fluid level sensors;

an auxiliary distribution station including, a mobile vehicle, an auxiliary hose reel and auxiliary hose on the mobile vehicle, the auxiliary hose reel having first and second connectors, the first connector being secured with the auxiliary hose and the second connector being configured to be secured with a complementary connector end of one of the plurality of hoses of the primary distribution station such that fluid delivered through the one of the plurality of hoses of the primary distribution station flows through the auxiliary hose reel and into the auxiliary hose, a lift on the mobile vehicle, the lift configured to move and deploy the auxiliary hose reel from the mobile vehicle, a first tank on the mobile vehicle, and an auxiliary distribution station pump, an auxiliary meter, and a tank hose, the auxiliary distribution station pump operable to pump fluid from the first tank, through the meter, and through the tank hose.

9. The distribution system as recited in claim 8, wherein the mobile vehicle is a truck.

10. The distribution system as recited in claim 8, wherein the lift is a winch.

11. The distribution system as recited in claim 8, further comprising at least a second tank and a third tank on the mobile vehicle, the third tank being different in volumetric size than the first tank and the second tank.

12. The distribution system as recited in claim 11, wherein the third tank is larger in volumetric size than the first tank and the second tank.

13. The distribution system as recited in claim 12, wherein the third tank is between the first tank and the second tank.

14. The distribution system as recited in claim 12, further comprising fuel in the first tank and diesel exhaust fluid in the third tank.

15. The distribution system as recited in claim 8, wherein the auxiliary hose includes a manual pump handle.

16. The distribution system as recited in claim 8, wherein the mobile vehicle has a cab and a truck bed, and the auxiliary hose reel is located in a rear 50% of the length of the truck bed.

17. The distribution system as recited in claim 16, wherein the lift is located in the rear 50% of the length of the truck bed.

18. The distribution system as recited in claim 17, wherein the lift is aft of the auxiliary hose reel on the truck bed.

19. The distribution system as recited in claim 18, wherein the lift is a winch.

* * * * *